US005495837A

United States Patent [19]

Mitsuhashi et al.

[11] Patent Number: 5,495,837

[45] Date of Patent: Mar. 5, 1996

[54] ENGINE VALVE HAVING IMPROVED HIGH-TEMPERATURE WEAR RESISTANCE

[75] Inventors: Akira Mitsuhashi; Saburo Wakita, both of Omiya; Tsutomu Oka; Osami Noguchi, both of Okegawa, all of Japan

[73] Assignee: Mitsubishi Materials Corporation, Tokyo, Japan

[21] Appl. No.: 353,915

[22] Filed: Dec. 12, 1994

[30] Foreign Application Priority Data

| | | | |
|---|---|---|---|
| Jun. 11, 1993 | [JP] | Japan | 5-166236 |
| Feb. 18, 1994 | [JP] | Japan | 6-043293 |
| Feb. 28, 1994 | [JP] | Japan | 6-054504 |

[51] Int. Cl.[6] ..... F01L 3/02

[52] U.S. Cl. ..... 123/188.3; 251/368

[58] Field of Search ..... 123/188.1, 188.2, 123/188.3; 251/368

[56] References Cited

U.S. PATENT DOCUMENTS 5,422,321 6/1995 Whalen et al. ..... 123/188.3

FOREIGN PATENT DOCUMENTS

| | | | |
|---|---|---|---|
| 112206 | 9/1978 | Japan | 123/188.3 |
| 211557 | 11/1984 | Japan | 123/188.3 |
| 3199604 | 8/1991 | Japan | 123/188.3 |
| 6146824 | 5/1994 | Japan | 123/188.3 |

*Primary Examiner*—Henry C. Yuen
*Assistant Examiner*—Erick Solis
*Attorney, Agent, or Firm*—Armstrong, Westerman, Hattori, McLeland & Naughton

[57] ABSTRACT

A coated valve face of an engine valve is formed of an Fe-based alloy having a composition consisting essentially of, by weight, 0.7 to 1.5% of C, 10 to 15% of Mn, 24 to 30% of Cr, 6.1 to 9.8% of Mo, 10 to 15% of Ni, 0.1 to 0.4% of N, 0.2 to 1.5% of Si, and optionally at least one of 0.1 to 5% of Nb, 0.1 to 5% of Ta and 0.15% of W as required (the total content of Nb, Ta and W being limited to 5% or less), and the balance substantially Fe and inevitable impurities, and having a two-phase structure formed of an austenitic phase and an eutectic carbide phase. In another embodiment, the composition contains between 0.05 to 1% Co. The Fe-based alloys are preferably applied to the valve face by plasma beam or laser beam coating of powdered such alloys onto the valve face.

26 Claims, 2 Drawing Sheets

ENGINE VALVE HAVING IMPROVED HIGH-TEMPERATURE WEAR RESISTANCE

FIELD OF THE INVENTION

This invention relates to an engine valve having improved high-temperature wear resistance.

BACKGROUND OF THE INVENTION

It is well known that conventional engine valves provided as a structural member of vehicle engines or the like are manufactured by using, for example, one of various Fe-based alloy powders including one described in Japanese Patent Laid-Open Publication No. 92494/1990 as a coating material on a valve face of an engine valve body formed of heat resistant steel or stainless steel, i.e., a surface which is brought into contact with a valve seat and where locally high wear resistance is required, and by welding the Fe based alloy powder by plasma arc coating or laser beam coating.

On the other hand, the development of motor vehicles having higher power and higher traveling speeds has been promoted in recent years. The engines of such motor vehicles are necessarily operated at a condition at a higher temperature. Accordingly, engine valves, as an engine structural member, are exposed to an atmosphere of a higher temperature. In the case of conventional engine valves, however, the high-temperature wear resistance of the Fe-based alloy with which the valve face is coated is not high enough to limit the progress of wear of the valve face, which is accelerated under a high-temperature condition.

SUMMARY OF THE INVENTION

The inventors of the present invention have made studies particularly on the high-temperature wear resistance of an engine valve face from the above-described view point, and have discovered, in a first embodiment of the invention, that an Fe-based alloy forming the valve face of an engine valve has very high-temperature wear resistance, such that the wear of the valve face during engine operation at a further higher temperature can be effectively limited, if a coating of an Fe-based alloy forming the valve face has a composition consisting essentially of, by weight:

0.7 to 1.5% of C, 10 to 15% of Mn, 24 to 30% of Cr, 6.1 to 9.8% of Mo, 10 to 15% of Ni, 0.1 to 0.4% of N, 0 2 to 1.5% of Si, and the balance substantially Fe and inevitable impurities, and has a two-phase structure formed of an austenitic phase and an eutectic carbide phase as shown in a metallographic microscopic photograph of FIG. 1, preferably a structure in which the area percentage of the eutectic carbide phase is 10 to 50% and in which the spacing of secondary dendritic arms of theaustenitic phase is 15 μm or less. The percentage by weight of constituent elements will be denoted only "%" in this specification.

The Fe-based alloy may also contain at least one of 0.1 to 5% of Nb, 0.1 to 5% of Ta and 0.1 to 5% of W (the total content of Nb, Ta and W being limited to 5% or less).

In another embodiment, the present invention has been achieved on the basis of this study result to provide an engine valve which has a valve face formed by being coated with an Fe-based alloy powder, and which is characterized in that its high-temperature wear resistance is improved by forming the coated valve face with an Fe-based alloy having a composition consisting essentially of:

0.7 to 1.5% of C, 10 to 15% of Mn, 24 to 30% of Cr, 6.1 to 9.8% of Mo, 10 to 15% of Ni, 0.1 to 0.4% of N, 0.2 to 1.5% of Si, at least one of 0.1 to 5% of Nb, 0.1 to 5% of Ta, 0.1 to 5% of W (the total content of Nb, Ta and W being limited to 5% or less.

The balance substantially Fe and inevitable impurities, and having a two-phase structure formed of an austenitic phase and an eutectic carbide phase.

In another embodiment of the present invention, we have discovered that an Fe-based alloy forming a valve face of an engine valve has very high high-temperature wear resistance such that the wear of the valve face during engine operation at a further higher temperature can be effectively limited if the Fe-based alloy forming the valve face has a composition consisting essentially of, by weight:

0.7 to 1.5% of C, 10 to 15% of Mn, 24 to 30% of Cr, 6.1 to 9.8% of MO, 10 to 15% of Ni, 0.1 to 0.4% of N, 0.2 to 1.5% of Si, 0.05 to 1% of Co, and the balance substantially Fe and inevitable impurities, and has a two-phase structure formed of an austenitic phase and an eutectic carbide phase, preferably a structure in which the area percentage of the eutectic carbide phase is 10 to 50% and in which the spacing of secondary dendritic arms of the austenitic phase is 15 μm or less. The percentage by weight of constituent elements will be denoted only by "%" in this specification.

The Fe-based alloy may also contain at least one of 0.1 to 5% of Nb, 0.1 to 5% of Ta, and 0.1 to 5% of W (the total content of Nb, Ta and W being limited to 5% or less).

The present invention has been achieved on the basis of this study result to provide an engine valve which has a valve face formed by being coated with an Fe-based alloy powder, and which is characterized in that its high-temperature wear resistance is improved by forming the coated valve face with an Fe-based alloy having a composition consisting essentially of:

0.7 to 1.5% of C, 10 to 15% of Mn, 24 to 30% of Cr, 6.1 to 9.8% of Mo, 10 to 15% of Ni, 0.1 to 0.4% of N, 0.2 to 1.5% of Si, 0.05 to 1% of Co, at least one of 0.1 to 5% of Nb, 0.1 to 5% of Ta and 0.1 to 5% of W (the total content of Nb, Ta and W being limited to 5% or less), and the balance substantially Fe and inevitable impurities, and having a two-phase structure formed of an austenitic phase and an eutectic carbide phase.

DETAILED DESCRIPTION

Figure 1:
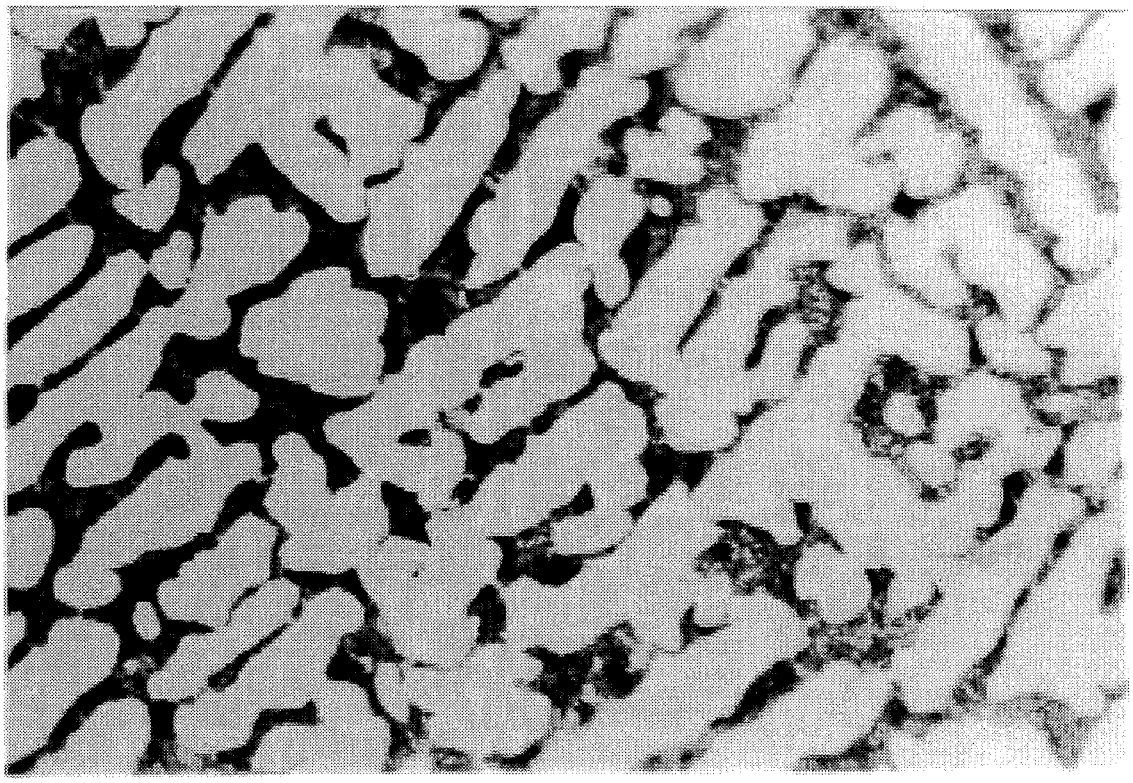
FIG. 1 is a metallographic microscopic photograph of the structure of a valve face prepared according to the present invention.

The reason for limiting the components of the Fe-based alloy forming the coated valve face of the engine valve of the present invention as described above will be described below. The term "coating" is used herein to describe the application of the Fe-based alloy to the valve face while sometimes terms such as "surfacing", "hard-facing" or "padding" are also used to signify such application or layer.

(a) C

The C component is dissolved as a solid solution in the austenitic phase to improve the high-temperature strength of this phase, and forms the eutectic carbide phase to improve the high-temperature wear resistance of the alloy. If the content of C is 0.7% or less, these effects are not satisfactorily high. On the other hand, if the content of C exceeds 1.5%, the wear of the valve seat brought into contact with the engine valve is accelerated. Therefore, the content of C is limited within the range of 0.7 to 1.5% and, preferably, within the range of 0.9 to 1.3%.

(b) Mn

The Mn component forms the austenitic phase with Ni and Cr to improve the high-temperature corrosion resistance. If the content of Mn is 10% or less, the improvement in the high-temperature corrosion resistance cannot be achieved. If the content of Mn exceeds 15%, the high-temperature wear resistance is reduced. Therefore, the content of Mn is limited within the range of 10 to 15% and, preferably, within the range of 11 to 13%.

(c) Cr

The Cr component forms the austenitic phase having high-temperature corrosion resistance, as mentioned above, and also forms the eutectic carbide phase to improve the high-temperature wear resistance. If the content of Cr is 24% or less, these effects are not satisfactorily high. If the content of Cr exceeds 30%, the damage to the valve seat brought into contact with the engine valve is abruptly increased. Therefore, the content of Cr is limited within the range of 24 to 30% and, preferably, within the range of 15.5 to 27.5.

(d) Mo

The Mo component is dissolved as a solid solution in the austenitic phase to improve the high-temperature wear resistance Of this phase. If the content of Mo is 6.1% or less, the desired improved high-temperature wear resistance cannot be achieved. If the content of Mo exceeds 9.8%, the high-temperature corrosion resistance is reduced. Therefore, the content of Mo is limited within the range of 6.1 to 9.8% and, preferably, within the range of 6.4 to 8%.

(e) Ni

The Ni component forms the austenitic phase having improved high-temperature corrosion resistance with Mn and Cr, as mentioned above. If the content of Ni is 10% or less, the austenitic phase having the desired high-temperature corrosion resistance cannot be formed. If the content of Ni exceeds 15%, the high-temperature wear resistance is reduced. Therefore, the content of Ni is limited within the range of 10 to 15% and, preferably, within the range of 11 to 13%.

(f) N

The N component forms a finely-dispersed carbo-nitride to improve the high-temperature wear resistance. If the content of N is 0.1% or less, this effect is not satisfactorily high. If the content of N exceeds 0 4% coating weldability is deteriorated. Therefore, the content of N is limited within the range of 0.1 to 0.4% and, preferably, within the range of 0.2 to 0.3%.

(g) Si

The Si component acts to improve the fluidity (molten metal flowability) at the time of coating, and has such a strong deoxidizing effect that the coating weldability is improved. If the content of Si is 0.2% or less, these effects are not satisfactorily high. If the content of Si exceeds 1.5%, the tenacity is reduced so that a crack can occur easily. Therefore, the content of Si is limited within the range of 0.2 to 1.5% and, preferably 0.4 to 0.8%.

(h) Co (when used in an embodiment of the present invention)

The Co component is dissolved as a solid solution in the austenitic phase to improve the high-temperature stability of this phase so that the alloy has improved high-temperature wear resistance and high-temperature corrosion resistance in a high-temperature combustion gas atmosphere. If the content of Co is 0.05% or less, this effect is not satisfactorily high. If the content of Co exceeds 1%, this effect is saturated and a further improvement in wear/corrosion resistance cannot be obtained. Therefore, the content of Co is limited within the range of 0.05 to 1% and, more preferably, within the range of 0.1 to 0.5%.

(i) Nb, Ta and W

The Nb, Ta and W components, when present, are added according to one's need because they can be dissolved as a solid solution in the austenitic phase to further improve the high-temperature wear resistance of this phase. If the content of some of these components contained is 0.1% or less, the desired improved high-temperature wear resistance cannot be obtained. If the total amount of at least one of these components contained exceeds 5%, a high temperature formation type carbide other than the eutectic carbide phase is formed to cause a deterioration in the coating weldability. Therefore, the content of these components is limited within the range of 0.1 to 5% and, preferably, within the range of 0.5 to 2.5%. Also, the total content of these components is 5% or less and, preferably, 3% or less.

(j) Inevitable Impurities

It is impossible to prevent impurities from mixing in the alloy because of the existence of impurities contained in raw alloy materials, a deoxidizer at the time of coating, and contamination from furnace members. However, the properties of the engine valve are not seriously damaged if the contents of mixed impurities are such that Al: at most is present in an amount of 0.1%;

B: at most is present in an amount of 0.05%;

P: at most is present in an amount of 0.04%;

S: at most is present in an amount of 0.05%; and

O: at most is present in an amount of 0.05%.

(k) Eutectic Carbide Area Percentage

An engine valve having a valve face formed by the Fe-based alloy of the present invention, having a structure formed of an austenitic phase and an eutectic carbide phase grown dendritically in primary phase, can be manufactured by coating. However, if the area percentage of the eutectic carbide phase is 10% or less, the effect of improving the high-temperature wear resistance is not satisfactorily high. On the other hand, if the area percentage exceeds 50%, the coating weldability is lowered. Therefore, the area percentage of the eutectic carbide phase is limited within the range of 10 to 50%.

(l) The distance between Secondary Dendritic Arms of Austenitic Phase

Secondary dendritic arms are formed when the austenitic phase is solidified and grown at the time of coating. If the distance between the secondary dendritic arms is excessively large, the uniformity of the structure is deteriorated and the austenitic phase coarsely formed can be deformed easily, resulting in a reduction in high-temperature wear resistance. Therefore, it is desirable to set the secondary dendritic arm spacing to 15 μm or less.

EXAMPLE I

Examples of one embodiment of the engine valve of the present invention will now be described.

Molten Fe-based alloys having compositions shown in Tables 1 and 2 were prepared and were deoxidized with Al and/or Mg according to requirements. The alloys were then pulverized into Fe-based alloy powders each having an average grain size of 110 μm by gas atomization using $N_2$ gas. Each of these powders was used as a coating material to form a valve face of a motor vehicle engine valve having a head diameter of 31.5 mm and made of SUH 35 steel (heat resistance steel) by plasma beam coating under the following conditions:

plasma current: 105 A/125 A, plasma gas flow rate: 0.9 l /min, shield gas flow rate: 15 l /min, powder supply gas flow rate: 1 l/min, and amount of coating on one valve: 3.0 to 4.0 g; and by laser beam coating under the following conditions:

laser output: 2.4 to 3.8 kW, shield gas flow rate: 15 l /min, and amount of coating on one valve: 3.0 to 4.0 g.

In this manner, engine valves 1 to 17 of Tables 1–3 of the present invention and comparative example engine valves 1 to 4 thereof were manufactured in which the coated valve faces were formed of Fe-based alloys having substantially the same compositions as the above-mentioned Fe-based powders. The area percentage of the eutectic carbide phase and the distance between secondary dendritic arms were measured in a cross section of the structure of the coated valve face of each valve observed through a metallographic microscope.

In each of the comparative engine valves 1 to 4, the content of one of the components for improving the high-temperature wear resistance, i.e., C, Cr or Mo, among the components of the Fe-based alloys forming the coated valve faces, is below the lower limit of the content range in accordance with the present invention.

Each of the valves thus manufactured to have various valve face compositions was set in a 2000 cc gasoline engine to undergo an accelerated wear test under the following conditions:

gasoline used: leaded gasoline Pb content: 1.8 g/l)

engine speed: 7500 r.p.m.

operating time: 100 hours, and the maximum wear depth after the operation was measured. Table 3 shows the results of this test.

Table 3 also shows Vicker's hardnesses at ordinary temperature and a temperature of 800° C. of the coated valve faces of the engine valves 1 to 17 (load: 200 g) of the present invention and the comparative example engine valves 1 to 4. FIG. 1 shows a metallographic microscopic photograph of the structure of the engine valve 2 (Table 1) of the present invention (magnification: 500).

From the results shown in Tables 1 to 3, it is apparent that the coated valve face of each of the engine valves 1 to 17 of the present invention has improved high-temperature hardness and also has improved high-temperature wear resistance with an eutectic carbide phase area percentage of 10 to 50%, and that, as in the comparative example engine valves 1 to 4, the high-temperature hardness is relatively reduced and the high-temperature wear resistance is also lowered if the content of only one of the components of the Fe-based alloy forming the coated valve face, i.e., C, Cr, Mo or N, is smaller than the lower limit of the range in accordance with the present invention (as indicated by * in Table 2).

In the engine valve of the present invention, as described above, the coated valve face which undergoes severe wearing by being repeatedly brought into contact with the mated valve seat is formed of an Fe-based alloy having improved high-temperature hardness and wear resistance, thereby ensuring improved performance for a long time even in a high-temperature atmosphere caused during high-output and high-speed engine operation.

TABLE 1

| | Chemical composition of Fe-base alloy powder (hardfacing alloy) (weight %) | | | | | | | | | | | Micro-structure of hardfacing scat valve | |
|---|---|---|---|---|---|---|---|---|---|---|---|---|---|
| | C | Mn | Cr | Mo | Ni | N | Si | Nb | Ta | W | Fe + impurities | Ratio of entectic carbide phase area (%) | Secondary dendride arms spacing (μm) |
| | | | | | | | | Valve of this invention | | | | | |
| 1 | 0.70 | 12.6 | 25.9 | 7.10 | 11.3 | 0.26 | 0.56 | — | — | — | balance | 12 | 8 |
| 2 | 1.02 | 12.6 | 26.0 | 7.11 | 12.2 | 0.31 | 0.65 | — | — | — | balance | 29 | 6 |
| 3 | 1.45 | 12.8 | 23.6 | 7.01 | 11.1 | 0.22 | 0.70 | — | — | — | balance | 47 | 14 |
| 4 | 1.10 | 12.3 | 29.6 | 7.78 | 10.6 | 0.18 | 0.81 | — | — | — | balance | 38 | 11 |
| 5 | 1.05 | 10.1 | 24.2 | 7.99 | 10.7 | 0.31 | 0.49 | — | — | — | balance | 37 | 11 |
| 6 | 1.08 | 14.8 | 26.0 | 6.10 | 12.3 | 0.14 | 0.68 | — | — | — | balance | 29 | 9 |
| 7 | 1.12 | 12.7 | 26.5 | 7.24 | 14.2 | 0.25 | 0.50 | — | — | — | balance | 32 | 4 |
| 8 | 1.08 | 11.2 | 26.4 | 9.47 | 11.1 | 0.31 | 0.78 | — | — | — | balance | 31 | 7 |
| 9 | 1.03 | 11.9 | 26.7 | 7.48 | 12.9 | 0.28 | 0.26 | — | — | — | balance | 33 | 6 |
| 10 | 1.14 | 12.1 | 24.8 | 7.60 | 11.1 | 0.31 | 0.93 | — | — | 1.5 | balance | 41 | 7 |
| 11 | 1.06 | 12.0 | 26.2 | 1.46 | 12.5 | 0.24 | 1.43 | — | 0.3 | — | balance | 28 | 4 |
| 12 | 0.93 | 12.5 | 25.4 | 7.71 | 12.6 | 0.25 | 0.74 | 0.4 | — | — | balance | 34 | 5 |
| 13 | 0.98 | 12.7 | 26.3 | 7.08 | 11.4 | 0.33 | 0.81 | — | 1.0 | 1.1 | balance | 32 | 4 |

TABLE 2

| | Chemical composition of Fe-base alloy powder (hardfacing alloy) (weight %) | | | | | | | | | | | Micro-structure of hardfacing scat valve | |
|---|---|---|---|---|---|---|---|---|---|---|---|---|---|
| | C | Mn | Cr | Mo | Ni | N | Si | Nb | Ta | W | Fe + impurities | Ratio of entectic carbide phase area (%) | Secondary dendride arms spacing (μm) |
| | | | | | | | | Valve of this invention | | | | | |
| 14 | 1.00 | 11.0 | 25.2 | 7.81 | 11.5 | 0.27 | 0.81 | 0.9 | 0.7 | 3.1 | balance | 37 | 4 |
| 15 | 1.04 | 12.5 | 26.3 | 7.62 | 12.8 | 0.31 | 0.58 | — | 0.5 | 0.5 | balance | 32 | 5 |
| 16 | 1.09 | 12.1 | 25.9 | 7.18 | 13.1 | 0.29 | 0.72 | 3.0 | — | 1.2 | balance | 34 | 7 |
| 17 | 0.98 | 12.4 | 26.6 | 7.34 | 12.7 | 0.29 | 0.74 | — | — | — | balance | 38 | 7 |
| | | | | | | | | Comparative valve | | | | | |
| 1 | 0.59* | 12.0 | 26.3 | 7.60 | 10.1 | 0.31 | 0.75 | — | — | — | balance | 21 | 9 |
| 3 | 0.78 | 11.6 | 21.8* | 7.31 | 12.4 | 0.34 | 0.73 | — | — | — | balance | 38 | 10 |
| 3 | 0.79 | 11.5 | 26.4 | 4.25* | 12.0 | 0.29 | 0.69 | — | — | — | balance | 27 | 6 |
| 4 | 1.01 | 13.4 | 26.6 | 7.51 | 12.6 | 0.05* | 0.68 | — | — | — | balance | 31 | 8 |

TABLE 3

| | Hardfacing seat of valve | | | |
|---|---|---|---|---|
| | Vickers hardness | | Maximum wear depth (μm) | |
| | Room temperature | 1000° C. | Plasma transferred arc welding | Laser welding |
| | Valve of this invention | | | |
| 1 | 406 | 251 | 3 | 3 |
| 2 | 425 | 278 | 2 | 1 |
| 3 | 451 | 284 | 1 | 1 |
| 4 | 432 | 280 | 2 | 2 |
| 5 | 417 | 268 | 2 | 2 |
| 6 | 408 | 263 | 4 | 3 |
| 7 | 408 | 254 | 5 | 3 |
| 8 | 435 | 270 | 1 | 2 |
| 9 | 422 | 264 | 2 | 1 |
| 10 | 439 | 273 | 2 | 3 |
| 11 | 431 | 260 | 2 | 3 |
| 12 | 448 | 271 | 1 | 1 |
| 13 | 451 | 276 | 1 | 2 |
| 14 | 453 | 280 | 1 | 1 |
| 15 | 443 | 286 | 3 | 3 |
| 16 | 441 | 281 | 2 | 2 |
| 17 | 426 | 279 | 4 | 3 |

TABLE 3-continued

| | Hardfacing seat of valve | | | |
|---|---|---|---|---|
| | Vickers hardness | | Maximum wear depth (μm) | |
| | Room temperature | 1000° C. | Plasma transferred arc welding | Laser welding |
| | Comparative valve | | | |
| 1 | 380 | 225 | 12 | 8 |
| 2 | 370 | 212 | 9 | 9 |
| 3 | 375 | 204 | 7 | 7 |
| 4 | 361 | 192 | 7 | 9 |

EXAMPLE II

Examples of another embodiment of the engine valve of the present invention, where Co is present, will now be described.

Molten Fe-based alloys having compositions shown in Tables 4, 5, and 6 were prepared and were deoxidized with Al and/or Mg according to requirements. The alloys were then pulverized into Fe-based alloy powders each having an average grain size of 110 μm by gas atomization using $N_2$ gas. Each of these powders was used as a coating material to form a valve face of a motor vehicle engine valve having a head diameter of 31.5 mm and made of SUH 35 steel (heat resistance steel) by plasma beam coating under the following conditions:

plasma current: a predetermined value in the range of 115 to 125 A plasma gas flow rate: 1.1 l/min, shield gas flow rate: 10 l /min, powder supply gas flow rate: 1 l/min, and amount of coating on one valve: 3.6 g; and by laser beam coating under the following conditions:

laser output: a predetermined value in the range of 2 to 3 kW, shield gas flow rate: 10 l /min, and amount of coating on one valve: 3.6 g.

In this manner, engine valves 1 to 30 of Tables 4–8 of the present invention and comparative example engine valves 1 to 5 thereof were manufactured in which the coated valve faces were formed of Fe-based alloys having substantially the same compositions as the above-mentioned Fe-based powders.

In each of the comparative engine valves 1 to 5, the content of one of the components for improving the high-temperature wear resistance, i.e., C, Cr; Mo or Co, among the components of the Fe-based alloys forming the coated valve faces, is below the lower limit of the content range in accordance with the present invention.

An arbitrary portion in the coated valve face of each of the thus-obtained various engine valves at a depth of 0.1 mm was observed with a metallographic microscope, and a photograph of the structure thereof was taken. From this structure, the area percentage of the eutectic carbide phase and the distance between center lines of secondary dendritic arms forming the austenitic phase were measured (measured in arbitrary five places and averaged).

Each of the valves thus manufactured to have various valve face compositions was set in a 2000 cc gasoline engine to undergo an accelerated wear test under the following conditions:

gasoline used: leaded gasoline (Pb content: 1.5 g/l)

engine speed: 7000 r.p.m.

operating time: 200 hours, and the maximum wear depth after the operation was measured. Tables 7 and 8 show the results of this test.

Tables 7 and 8 also show Vicker's hardnesses at ordinary temperature and a temperature of 1000° C. (load: 200 g) of the coated valve faces of the engine valves 1 to 30 of the present invention and the comparative example engine valves 1 to 5.

Figure 2:
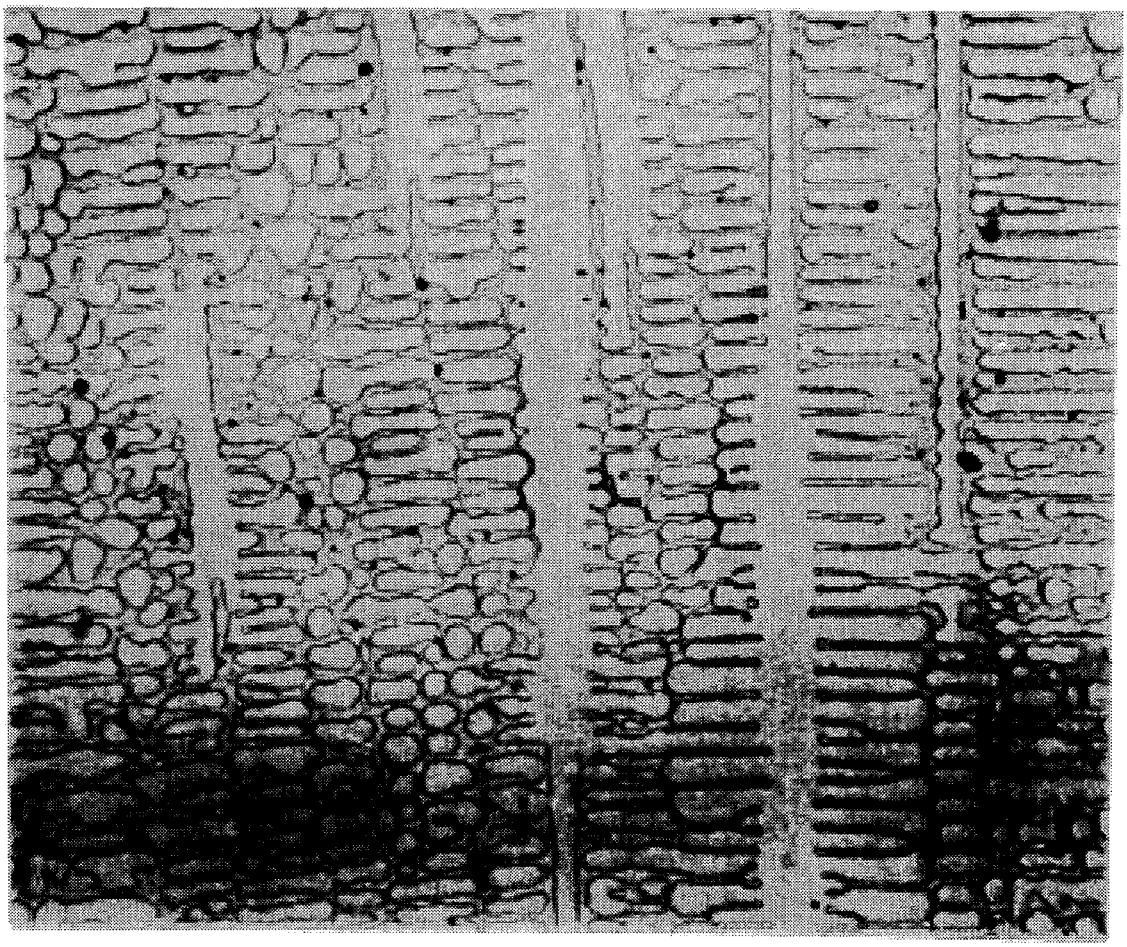
FIG. 2 is a metallographic microscopic photograph of the structure of a valve face prepared according to another embodiment of the present invention.

FIG. 2 shows a metallographic microscopic photograph of the structure of an arbitrary portion in the coated valve face of the engine valve 2 (Table 4) of the present invention at a depth of 0.1 mm (magnification: 500).

From the results shown in Tables 4 to 8, it is apparent that the coated valve face of each of the engine valves 1 to 30 of the present invention has improved high-temperature hardness and also has improved high-temperature wear resistance, and that, as in the comparative example engine valves 1 to 5, the high-temperature hardness is relatively reduced and the high-temperature wear resistance is also lowered if the content of only one of the components of the Fe-based alloy forming the coated valve face, i.e., C, Cr, Mo, N or Co is smaller than the lower limit of the range in accordance with the present invention (as indicated by * in Table 6).

TABLE 4

| | Chemical composition of Fe-base alloy powder (hardfacing alloy) (weight %) | | | | | | | | | | | |
|---|---|---|---|---|---|---|---|---|---|---|---|---|
| | C | Mn | Cr | Mo | Ni | N | Si | Co | Nb | Ta | W | Fe + impurities |
| | | | | | Valve of this invention | | | | | | | |
| 1 | 0.72 | 12.1 | 26.7 | 7.13 | 12.3 | 0.32 | 0.54 | 0.23 | — | — | — | balance |
| 2 | 1.07 | 12.4 | 26.5 | 7.64 | 12.5 | 0.30 | 0.53 | 0.21 | — | — | — | balance |
| 3 | 1.46 | 12.3 | 26.8 | 7.09 | 12.1 | 0.25 | 0.50 | 0.24 | — | — | — | balance |
| 4 | 1.08 | 10.3 | 27.1 | 7.16 | 12.2 | 0.31 | 0.47 | 0.19 | — | — | — | balance |
| 5 | 1.12 | 14.9 | 26.4 | 7.33 | 12.4 | 0.32 | 0.57 | 0.26 | — | — | — | balance |
| 6 | 1.06 | 11.9 | 24.3 | 7.29 | 12.3 | 0.24 | 0.61 | 0.22 | — | — | — | balance |
| 7 | 1.12 | 11.8 | 29.7 | 7.52 | 12.0 | 0.29 | 0.68 | 0.61 | — | — | — | balance |
| 8 | 1.01 | 12.0 | 26.1 | 6.13 | 12.4 | 0.23 | 0.55 | 0.61 | — | — | — | balance |
| 9 | 1.00 | 12.2 | 27.2 | 9.75 | 12.5 | 0.31 | 0.52 | 0.43 | — | — | — | balance |
| 10 | 1.04 | 11.7 | 27.1 | 7.02 | 10.1 | 0.28 | 0.64 | 0.20 | — | — | — | balance |
| 11 | 1.08 | 11.8 | 26.9 | 7.12 | 14.8 | 0.32 | 0.57 | 0.31 | — | — | — | balance |

TABLE 5

| | Chemical composition of Fe-base alloy powder (hardfacing alloy) (weight %) | | | | | | | | | | | |
|---|---|---|---|---|---|---|---|---|---|---|---|---|
| | C | Mn | Cr | Mo | Ni | N | Si | Co | Nb | Ta | W | Fe + impurities |
| | | | | | Valve of this invention | | | | | | | |
| 12 | 1.09 | 12.3 | 26.4 | 7.24 | 12.5 | 0.12 | 0.48 | 0.26 | — | — | — | balance |
| 13 | 1.12 | 11.7 | 27.0 | 7.55 | 12.3 | 0.39 | 0.56 | 0.19 | — | — | — | balance |
| 14 | 1.08 | 12.6 | 25.4 | 7.06 | 12.4 | 0.30 | 0.22 | 0.34 | — | — | — | balance |
| 15 | 1.14 | 12.0 | 26.3 | 7.79 | 12.0 | 0.29 | 1.47 | 0.20 | — | — | — | balance |
| 16 | 1.05 | 11.8 | 26.2 | 7.42 | 11.8 | 0.31 | 0.62 | 0.054 | — | — | — | balance |

TABLE 5-continued

| | Chemical composition of Fe-base alloy powder (hardfacing alloy) (weight %) | | | | | | | | | | | |
|---|---|---|---|---|---|---|---|---|---|---|---|---|
| | C | Mn | Cr | Mo | Ni | N | Si | Co | Nb | Ta | W | Fe + impurities |
| 17 | 1.06 | 12.1 | 25.7 | 7.08 | 12.1 | 0.27 | 0.54 | 0.94 | — | — | — | balance |
| 18 | 1.09 | 11.9 | 27.0 | 7.24 | 12.3 | 0.29 | 0.56 | 0.24 | 0.16 | — | — | balance |
| 19 | 1.11 | 11.7 | 26.4 | 7.38 | 12.1 | 0.31 | 0.53 | 0.21 | 2.47 | — | — | balance |
| 20 | 1.08 | 12.1 | 26.3 | 7.13 | 12.5 | 0.32 | 0.52 | 0.26 | 4.92 | — | — | balance |
| 21 | 1.10 | 12.2 | 27.1 | 7.16 | 12.2 | 0.30 | 0.56 | 0.25 | — | 0.19 | — | balance |
| 22 | 1.07 | 12.3 | 26.6 | 7.29 | 12.0 | 0.28 | 0.55 | 0.23 | — | 2.32 | — | balance |
| 23 | 1.09 | 12.0 | 26.8 | 7.43 | 12.2 | 0.31 | 0.51 | 0.26 | — | 4.65 | — | balance |

TABLE 6

| | Chemical composition of Fe-base alloy powder (hardfacing alloy) (weight %) | | | | | | | | | | | |
|---|---|---|---|---|---|---|---|---|---|---|---|---|
| | C | Mn | Cr | Mo | Ni | N | Si | Co | Nb | Ta | W | Fe + impurities |
| | | | | | | Valve of this invention | | | | | | |
| 24 | 1.06 | 12.3 | 26.9 | 7.23 | 12.3 | 0.30 | 0.53 | 0.22 | — | — | 0.12 | balance |
| 25 | 1.12 | 12.0 | 26.7 | 7.14 | 12.6 | 0.28 | 0.50 | 0.27 | — | — | 2.41 | balance |
| 26 | 1.10 | 11.8 | 27.0 | 7.43 | 12.5 | 0.31 | 0.53 | 0.29 | — | — | 4.73 | balance |
| 27 | 1.08 | 11.9 | 26.7 | 7.33 | 12.1 | 0.30 | 0.52 | 0.24 | 0.64 | 0.32 | — | balance |
| 28 | 1.09 | 12.2 | 26.7 | 7.09 | 12.3 | 0.31 | 0.52 | 0.26 | 2.46 | — | 1.33 | balance |
| 29 | 1.11 | 12.0 | 26.9 | 7.52 | 12.0 | 0.31 | 0.56 | 0.21 | — | 1.94 | 2.14 | balance |
| 30 | 1.10 | 12.1 | 26.6 | 7.50 | 12.4 | 0.28 | 0.53 | 0.23 | 0.96 | 1.03 | 0.32 | balance |
| | | | | | | Comparative valve | | | | | | |
| 1 | 0.54* | 11.8 | 25.9 | 7.23 | 11.6 | 0.24 | 0.52 | 0.21 | — | — | — | balance |
| 2 | 1.08 | 12.1 | 21.6* | 7.31 | 12.3 | 0.26 | 0.61 | 0.28 | — | — | — | balance |
| 3 | 1.12 | 12.2 | 26.3 | 4.31* | 12.2 | 0.23 | 0.49 | 0.25 | — | — | — | balance |
| 4 | 1.16 | 12.1 | 26.4 | 7.36 | 12.6 | 0.03* | 0.53 | 0.21 | — | — | — | balance |
| 5 | 1.09 | 12.4 | 26.0 | 7.31 | 12.4 | 0.29 | 0.50 | —* | — | — | — | balance |

TABLE 7

| | Hardfacing seat of valve | | | | | |
|---|---|---|---|---|---|---|
| | Vickers hardness | | Maximum wear depth (μm) | | Ratio of entectic | Secondary dendride |
| | Room temperature | 100° C. | Plasma transferred arc welding | Laser welding | carbide phase area (%) | arms spacing (μm) |
| | | | Valve of this invention | | | |
| 1 | 397 | 248 | 3 | 3 | 14 | 9 |
| 2 | 416 | 259 | 2 | 2 | 34 | 4 |
| 3 | 451 | 269 | 1 | 1 | 46 | 4 |
| 4 | 407 | 248 | 2 | 2 | 34 | 10 |
| 5 | 431 | 261 | 1 | 1 | 37 | 8 |
| 6 | 414 | 249 | 3 | 2 | 36 | 7 |
| 7 | 421 | 253 | 2 | 2 | 29 | 5 |
| 8 | 425 | 247 | 2 | 2 | 36 | 7 |
| 9 | 422 | 260 | 2 | 2 | 28 | 7 |
| 10 | 407 | 245 | 3 | 3 | 32 | 9 |
| 11 | 415 | 255 | 2 | 2 | 34 | 10 |
| 12 | 403 | 243 | 4 | 2 | 28 | 12 |
| 13 | 430 | 263 | 1 | 1 | 31 | 8 |
| 14 | 410 | 250 | 2 | 2 | 34 | 9 |
| 15 | 418 | 263 | 1 | 1 | 39 | 6 |
| 16 | 419 | 260 | 2 | 2 | 37 | 8 |
| 17 | 421 | 271 | 2 | 1 | 36 | 4 |

TABLE 8

| | Hardfacing seat of valve | | | | | |
|---|---|---|---|---|---|---|
| | Vickers hardness | | Maximum wear depth (μm) | | Ratio of entectic | Secondary dendride |
| | Room temperature | 1000° C. | Plasma transferred arc welding | Laser welding | carbide phase area (%) | arms spacing (μm) |
| | | | Valve of this invention | | | |
| 18 | 409 | 262 | 3 | 2 | 36 | 7 |
| 19 | 418 | 269 | 2 | 2 | 37 | 7 |
| 20 | 422 | 278 | 2 | 1 | 28 | 4 |
| 21 | 416 | 256 | 2 | 2 | 41 | 6 |
| 22 | 419 | 272 | 2 | 1 | 21 | 8 |
| 23 | 426 | 274 | 1 | 1 | 34 | 8 |
| 24 | 413 | 260 | 3 | 2 | 31 | 10 |
| 25 | 431 | 269 | 2 | 1 | 37 | 7 |
| 26 | 430 | 269 | 1 | 1 | 34 | 7 |
| 27 | 418 | 252 | 2 | 2 | 32 | 8 |
| 28 | 419 | 251 | 2 | 1 | 35 | 5 |
| 29 | 429 | 271 | 1 | 1 | 40 | 6 |
| 30 | 432 | 273 | 3 | 2 | 35 | 4 |
| | | | Comparative valve | | | |
| 1 | 370 | 196 | 10 | 9 | 10 | 14 |
| 2 | 377 | 194 | 9 | 10 | 22 | 10 |
| 3 | 372 | 198 | 8 | 8 | 29 | 10 |
| 4 | 361 | 184 | 11 | 10 | 38 | 6 |
| 5 | 372 | 188 | 13 | 13 | 34 | 8 |

In the engine valve of the present invention, as described above, the coated valve face which undergoes severe wearing by being repeatedly brought into contact with the mated valve seat is formed of an Fe-based alloy having improved high-temperature hardness and wear resistance, thereby ensuring improved performance for a long time even in a high-temperature atmosphere caused during high-output and high-speed engine operation.

What is claimed is:

1. An engine valve having improved high-temperature wear resistance and having a valve face coated with an Fe-based alloy powder, said engine valve being characterized in that the Fe-based alloy forming said coated valve face has a composition consisting essentially of, by weight:

0.7 to 1.5% of C, 10 to 15% of Mn, 24 to 30% of Cr, 6.1 to 9.8% of Mo, 10 to 15% of Ni, 0.1 to 0.4% of N, 0.2 to 1.5% of Si, and the balance substantially Fe and inevitable impurities, and has a two-phase structure formed of an austenitic phase and an eutectic carbide phase.

2. The engine valve as defined in claim 1 wherein the composition of said valve face also includes at least one of 0.1 to 5% of Nb, 0.1 to 5% of Ta, and 0.1 to 5% of W, the total content of Nb, Ta and W being 5% or less.

3. The engine valve as defined in claim 1 wherein the area percentage of said eutectic carbide phase is 10–50% and the distance between secondary dendritic arms of said austenitic phase is 15 μm or less.

4. The engine valve as defined in claim 1 wherein said inevitable impurities comprise no more than 0.1%—Al, 0.04%—P, 0.05%—O, 0.05%—B and 0.05%—S.

5. The engine valve as defined in claim 1 wherein the composition of said valve face also includes 0.05 to 1.0% of Co.

6. The engine valve as defined in claim 5 wherein the composition of said valve face also includes at least one of 0.1 to 5% Nb, 0.1 to 5% Ta, and 0.1 to 5% of W, the total content of Nb, Ta and W being 5% or less.

7. The engine valve as defined in claim 5 wherein the area percentage of said eutectic carbide phase is 10–50% and the distance between secondary dendritic arms of said austenitic phase is 15 μm or less.

8. The engine valve as defined in claim 5 wherein said inevitable impurities comprises no more than 0.1%—Al, 0.04%—P, 0.05%—O, 0.05%—B and 0.05%—S.

9. The engine valve as defined in claim 5 wherein said C is present in an amount of 0.9 to 1.3%.

10. The engine valve as defined in claim 5 wherein said Mn present in an amount of 11 to 13%.

11. The engine valve as defined in claim 5 wherein said Cr is present in an amount of 25.5 to 27.5%.

12. The engine valve as defined in claim 5 wherein said Mo is present in an amount of 6.4 to 8%.

13. The engine valve as defined in claim 5 wherein said Ni is present in an amount of 11 to 13%.

14. The engine valve as defined in claim 5 wherein said N is present in an amount of 0.2 to 0.3%.

15. The engine valve as defined in claim 5 wherein said Si is present in an amount of 0.4 to 0.8%.

16. The engine valve as defined in claim 5 wherein said Co is present in an amount of 0.1 to 0.5%.

17. An engine valve having improved high-temperature wear resistance and having a valve face coated with an Fe-based alloy powder, said engine valve being characterized in that the Fe-based alloy forming said coated valve face has a composition consisting essentially of, by weight:

0.7 to 1.5% of C, 10 to 15% of Mn, 24 to 30% of Cr, 6.1 to 9.8% of Mo, 10 to 15% of Ni, 0.1 to 0.4% of N, 0.2 to 1.5% of Si, at least one of 0.1 to 5% of Nb 0.1 to 5% of Ta and 0.1 to 5% of W, the total content of Nb, Ta and W being or less; and the balance substantially Fe and inevitable impurities, and has a two-phase structure formed of an austenitic phase and an eutectic carbide phase.

18. An engine valve having improved high-temperature wear resistance and having a valve face coated with an Fe-based alloy powder, said engine valve being characterized in that the Fe-based alloy forming said coated valve face has a composition consisting essentially of, by weight:

0.7 to 1.5% of C, 10 to 15% of Mn, 24 to 30% of Cr, 6.1 to 9.8% of Mo, 10 to 15% of Ni, 0.1 to 0.4% of N, 0.2 to 1.5% of Si, 0.05 to 1% of Co and the balance substantially Fe and inevitable impurities, and has a two-phase structure formed of an austenitic phase and an eutectic carbide phase.

19. An engine valve having improved high-temperature wear resistance and having a valve face coated with an Fe-based alloy powder, said engine valve being characterized in that the Fe-based alloy forming said coated valve face has a composition consisting essentially of, by weight:

0.7 to 1.5% of C, 10 to 15% of Mn, 24 to 30% of Cr, 6.1 to 9.8% of Mo, 10 to 15% of Ni, 0.1 to 0.4% of N, 0.2 to 1.5% of Si, 0.05 to 1% of Co at least one of 0.1 to 5% of Nb, 0.1 to 5% of Ta and 0.1 to 5% of W, the total content of Nb, Ta and W being limited to 5% or less, and the balance substantially Fe and inevitable impurities, and has a two-phase structure formed of an austenitic phase and an eutectic carbide phase.

20. A method of forming a high-temperature wear resistant valve face on an engine valve by coating the valve face with an Fe-based alloy having a composition consisting essentially of, by weight:

0.7 to 1.5% of C, 10 to 15% of Mn, 24 to 30% of Cr, 6.1 to 9.8% of Mo, 10 to 15% of Ni, 0.1 to 0.4% of N, 0.2 to 1.5% of Si, and the balance substantially Fe and inevitable impurities, with the resultant coating having a two-phase structure formed as an austenitic phase and an eutectic carbide phase.

21. The method as defined in claim 20 wherein said Fe-based alloy also includes at least one of 0.1 to 5% of Nb, 0.1 to 5% of Ta, and 0.1 to 5% of W, the total content of Nb, Ta and W being 5% or less.

22. The method as defined in claim 20 wherein the area percentage of said eutectic carbide phase is 10–50% and the distance between secondary dendritic arms of said austenitic phase is 15 μm or less.

23. The method as defined in claim 20 wherein said inevitable impurities comprise no more than 0.1%—Al, 0.04%—P, 0.05%—O, 0.05%—B and 0.05%—S.

24. The method as defined in claim 20 wherein said Fe-based alloy includes 0.05 to 1.0% of Co.

25. The method as defined in claim 20 wherein said Fe-based alloy is a powder and is applied to said valve face by plasma beam coating.

26. The method as defined in claim 20 wherein said Fe-based alloy is a powder and is applied to said valve face by laser beam coating.

* * * * *